United States Patent [19]

Gresham

[11] 3,934,435

[45] Jan. 27, 1976

[54] DOOR LOCKSET AND STRIKE

[75] Inventor: William F. Gresham, San Clemente, Calif.

[73] Assignee: VSI Corporation, Pasadena, Calif.

[22] Filed: Sept. 26, 1974

[21] Appl. No.: 509,656

[52] U.S. Cl. ..... 70/150; 70/106; 292/153; 292/163; 292/169.21; 292/340; 292/DIG. 31

[51] Int. Cl.[2] ..... E05B 65/06

[58] Field of Search ..... 70/106, 150, 152, 448; 292/153, 163, 169.21, 173, 337, 340, DIG. 31

[56] References Cited

UNITED STATES PATENTS

| | | | |
|---|---|---|---|
| 915,873 | 3/1909 | Mosher | 292/337 |
| 1,056,036 | 3/1913 | Loy | 70/322 |
| 1,069,753 | 8/1913 | Appleby | 292/173 |
| 1,399,897 | 12/1921 | Singer | 292/340 |
| 2,900,204 | 8/1959 | Pelcin | 292/173 |
| 3,266,277 | 8/1966 | Chesler | 70/150 |
| 3,786,657 | 1/1974 | Loikitz | 70/150 |
| 3,790,196 | 2/1974 | Sanders et al. | 292/140 |

*Primary Examiner*—Albert G. Craig, Jr.
*Attorney, Agent, or Firm*—Christie, Parker & Hale

[57] ABSTRACT

A lockset has a die cast, monolithic body pivotally supporting a lever handle which upon actuation and through fingers engages tabs of a lock bolt assembly for selective linear retraction of the latter. A rotatable knob carried by the body through a spindle and a guide plate mounts a cam plate which acts, upon rotation of the knob in either direction, to retract the bolt assembly. The bolt has opposed U-shaped guides which receive the guide plate and guide the bolt laterally and vertically. A lock has a lock lever which positively engages the bolt assembly to lock the latter in place. A follower lever and the lock lever are pivoted about a common axis. The follower responds to a barrel lock between two positions to lock and unlock the lock lever from the bolt assembly. The lock lever also responds to a latch pin independently of the follower on the opposite side of the lockset from the barrel lock, to lock and unlock the bolt assembly. A monolithic lock strike has lateral passages for receiving shanks of an interlock bar. Heads of the interlock bar interfere with the strike to resist forces separating the lock strike from the lockset.

26 Claims, 8 Drawing Figures

DOOR LOCKSET AND STRIKE

BACKGROUND OF THE INVENTION

The present invention relates in general to locksets and strikes and in particular to a lockset, a lock and a strike which are especially suitable for use with recreational vehicles, such as motor homes.

The requirements of a satisfactory lockset and strike for general application are well known. The lockset must provide security against unauthorized entry into a space it protects. It is preferably strong and tamperproof, but of relatively modest cost. One should be able to lock and unlock from either side of the device. The lockset should be reliable and simple to operate.

In specialized applications, such as in recreation vehicles, the requirements of a lockset and a cooperating strike become more stringent. In such an application there are forces which tend to separate the lockset from the strike. These forces are associated with flexure of the sides of the vehicle over the road. Quite obviously, such separation can cause a door to open. To prevent door opening, various devices have been proposed which effect interference between a lockset and a strike in the plane of flexure. The most popular of these is a headed stud and keyhole arrangement where the head interferes with material surrounding the keyhole when the shank of the stud passes through the keyhole. One of the problems with the stud method is that the studs have a tendency to bend and become loose, reducing the effectiveness of the jamb-door interlock.

An ideal lock is one which can be locked from both sides of a door and which can be opened from both sides of a door, regardless of where the door was locked. A lock with this facility avoids the problem, for example, of children locking themselves into a space.

Locks should be thin, yet strong, to suit a recreational vehicle environment.

SUMMARY OF THE INVENTION

The present invention provides an improved lockset of the type which is mounted in a door, say of a recreational vehicle. The lockset has a monolithic body preferably formed by die casting. This body mounts a lock bolt which is translational between an extended position with a tip or nose received in a mortise of a door jamb and a retracted position free of the mortise. The body has a head which defines a channel for the lock bolt proximate the jamb end of the lockset. The lock bolt itself has a pair of U-shaped, channel-like guides on the end thereof opposite the jamb, the interior end. These guides face the path of translation and receive a guide plate mounted on the body. The guide plate captures the lock bolt by overlying the channel and by the receiving of the guides. The guide plate preferably provides bearing for the nose end of the lock bolt. Means is provided to bias the lock bolt assembly into its extended position into the mortise. For this purpose, a spring housed in the body and bearing thereon can also directly bear on the lock bolt on the tab thereof. Means, such as a rotatable handle, engage the lock bolt from an inside side of the lockset for its selective retraction. Means, such as a lever, also engage the lock bolt from an outside side of the lockset for its selective retraction. Means is also provided to lock and unlock the lockset from either the inside or the outside.

Preferably, the means for retracting the lock bolt from the inside thereof includes a spindle rotatably mounted on the guide plate. Means, such as a handle or knob, is provided to turn the spindle in either direction about the latter's axis. A cam plate secured to the spindle has means for engaging and retracting the lock bolt assembly upon rotation caused by the turning means. Preferably the cam plate has a flange which is capable of bearing on the surface of a step of the lock bolt.

The means for retracting the lock bolt from the outside of the lockset preferably includes a lever pivotally secured to the body about an axis normal to the path of translation of the lock bolt. The lever has actuating fingers which extend toward the inside of the lockset for engagement of the flange. In a particular embodiment, the fingers selectively bear on depending tabs of the step which lie in the same plane as the step. Here, the cam plate and fingers are in the same plane when in repose. Preferably, the body has a pair of slots which parallel the path of the lock bolt and which receive the fingers of the lever.

The guide plate preferably is bent over the head on the jamb side of the lockset to provide a face. An aperture or passage in the face passes the lock bolt. The guide plate is attached to the head, as by fasteners. A shoe or tongue extends from the jamb end towards the interior end from the face to provide a bearing surface for the nose of the lock bolt. The guide plate confines the bolt between the tongue and a parallel portion of the plate, which is the portion that overlies the channel. Edges of the aperture which meet the tongue also provide bearing and guidance for the nose of the lock bolt.

The preferred lock bolt is an assembly of a solid nose and a thin plate. The latter is stepped in the manner described to provide a follower surface for the cam plate and actuating fingers.

The body provides the support for the other components of the lockset; preferably it also defines an escutcheon for the outside side of the lockset.

The lock of the lockset has a lock lever which selectively engages the lock bolt at the behest of an operator from either the inside or outside of the lockset. Means, such as a pin directly mounted to the lock lever, provide for its locking and unlocking from the inside. An eccentric lug, operable from outside the door, positions the lock lever in a locked and unlocked position, say through a key. The lug drives a follower lever which in turn operates the lock lever. Means, preferably a detent and slot in the levers, engage the lock lever with the follower lever in one of the positions of the latter and carry the lock lever with the follower to the alternate position. These means carry the lock lever between its locked and unlocked positions regardless of which position the lock lever was in originally.

Preferably, the lock lever and the follower are commonly pivoted to the body. Again the lock lever has a locked position, preferably with a nose or dog thereof in a notch of the lock bolt to interfere with retraction, and a free position away from the lock bolt where the lock bolt can translate. The follower lever again has two positions, one proximate the lock bolt and one remote from the lock bolt. The follower lever has an enclosed slot in receipt of the lug. The lug keeps the follower lever in either of its positions. A detent in one of the levers is engageable in either of a pair of detent slots in the other lever. One of the slots is close to the lock bolt and the other slot is further removed. The lug is operable, say by a key, to drive the follower lever and engage the remote slot and detent regardless of the position of the levers before engagement. When the lock lever is in the lock position, the detent engages the slot proximate the lock bolt even with the follower in the remote position. This engagement holds the lock lever locked.

The present invention contemplates a lock strike. The lock strike is of one-piece construction. It has ends adapted for mounting in a door jamb. The ends may be mounting tabs or bosses for receipt of fasteners. A medial section between the ends is raised from the ends. The medial section has a mortise for receipt of the nose of a lock bolt. Bearing surfaces of the mortise define primary and secondary keeper surfaces. The primary surface serves a normal keeping function to keep the lock bolt in the mortise. Upon failure of the primary surface, or perhaps more accurately the material backing the primary surface, the secondary surface serves to keep the lock bolt. A leading edge of the medial section is curled to present a convex outward curvature for transit bearing and retraction of the lock bolt during closure of the door. The medial section has retaining sections, each with a slot for receipt of a shank of an interlock mounted to the lockset. These retaining sections are on either sides of the curl. In use, the interlock has heads on each of the shanks which fall in behind the retaining section for interference with the retaining section upon loads tending to separate the door jamb and door in the plane of the door, and thus to keep the lock bolt in the mortise and the door from opening. Preferably, the interlock is constituted of a bar which, viewed along its length, is generally shaped like a U, with a bight which is flat and long relative to its legs. The bight provides mounting on a lockset and connects the legs. The legs are the shanks for receipt in the slots of the retaining sections of the strike. The shanks are capped by heads which extend away from each other for interference of the retaining sections. Preferably the strike has the curl ends beveled to guide the shanks of the interlock bar into the slots.

These and other features, aspects and advantages of the present invention will become more apparent from the following description, appended claims and drawings.

DESCRIPTION OF THE PREFERRED EMBODIMENT

Figure 1:
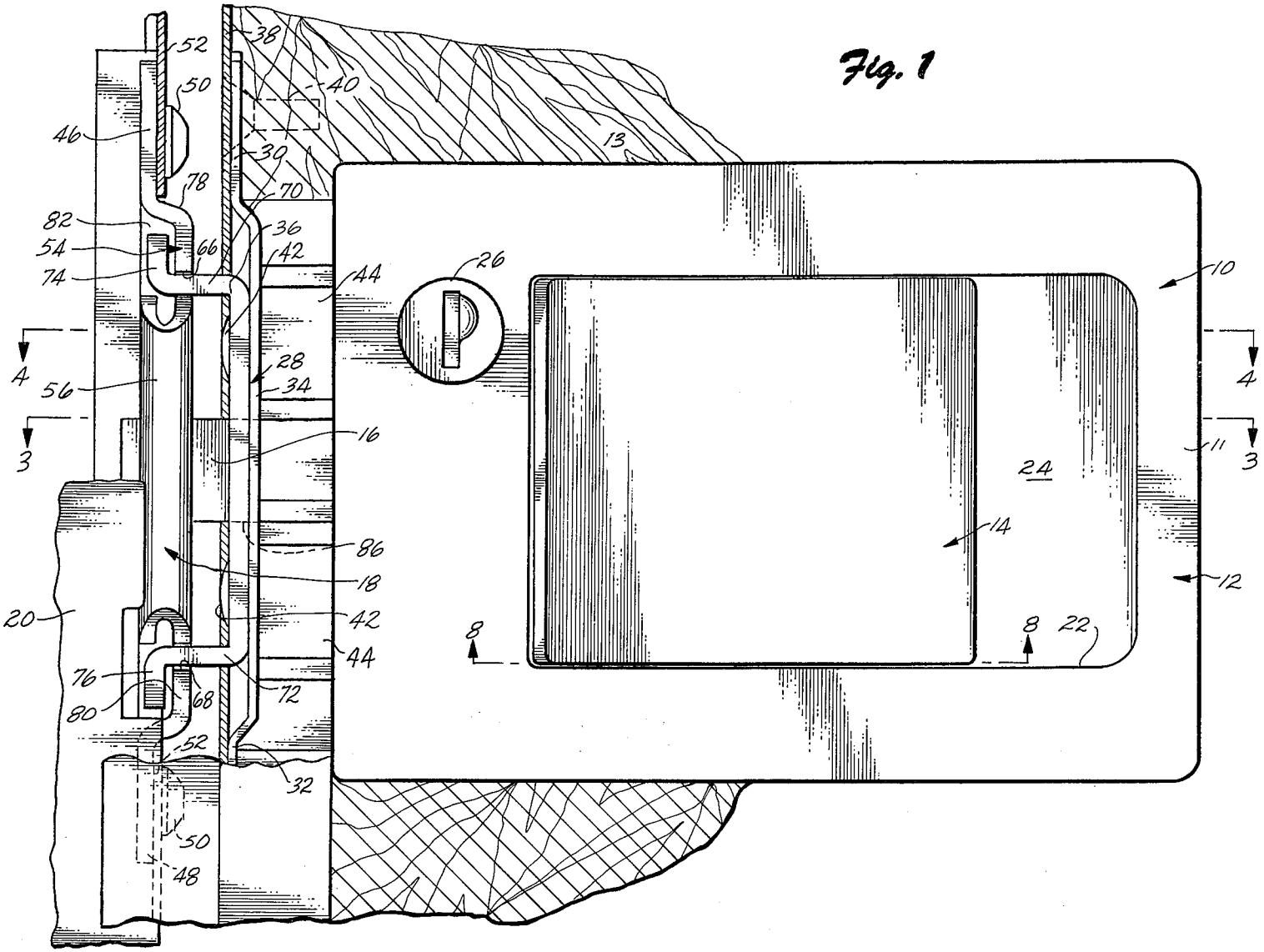
FIG. 1 is an elevational view of a lockset and strike of the present invention installed, respectively, in a door and a jamb, with the area proximate the interface of the jamb and the door being partly broken away and in section.

With initial reference to FIG. 1, a lockset 10 has an escutcheon 11 which is formed integrally with a monolithic body 12 and which presents an exterior face. The lockset is secured in a door 13, say of a recreational vehicle. A handle or lever 14 can retract a lock bolt 16 from a lock strike 18 secured in a jamb 20 of a wall, which may be a side wall of a recreational vehicle. A recess or pocket 22 in the monolithic body receives the lever so that the exterior surface of the latter is in the same plane as the surface of the escutcheon. A grip access opening 24 is defined by the recess for gripping the interior side of the lever. A standard barrel lock 26 is operable to lock and unlock the bolt, typically from the outside of a recreational vehicle.

A mounting plate 28 has mounting tabs 30 and 32 at its ends. A medial section 34 of the plate is stepped from these tabs to define a space for receipt of an interlock bar 36 with an outer facing surface of the bar flush with an inner facing surface of a protective apron 38 of the door. The inner facing surface of the bar abuts the medial section of the mounting plate. The apron and mounting plate abut at tabs 30 and 32 and share common fasteners 40. The fasteners with other fasteners (not shown) secure the apron to the door. Fasteners 40 alone secure the mounting plate to the door at tabs 30 and 32. Bar 36 is secured to body 12 by fasteners 42 engaged in threads of bar mounting bosses 44, the latter being part of the monolithic body 12 and shown best in FIGS. 4 through 7.

Strike 18 is a monolithic piece of high strength metal. Its ends are mounting tabs 46 and 48 for securing the strike to the jamb as by fasteners 50. An apron 52 serves as the jamb equivalent to door apron 38. Mounted, tabs 46 and 48 underlie and abut the apron and share common fasteners 50. The strike steps away from the mounting tabs towards the door and then continues with a medial section 54, which generally parallels the mounting tabs. As seen in both FIGS. 1 and 2, a leading lip 56 of the medial section is rolled over or curled back onto itself with an inner end of the curl in a plane of the interior surfaces of mounting tabs 46 and 48. The lip defines a very stiff medial section to resist flexure loads in the plane of FIG. 1, that is, parallel to the sides of the door and wall in which the strike and the lockset are installed. As seen best in FIG. 2, the strike is mortised at 58 to receive a nose 60 of lock bolt 16 of the lockset. The curl is rounded for smooth wiping of a bevel 61 of the lock bolt nose during door closing. The perimeter of the mortise defines primary and secondary keeper surfaces 62 and 64, respectively. Primary surface 62 interferes with nose 60 to keep the door closed. Surface 64 does the same job upon partial or complete failure of surface 62.

With reference back to FIG. 1, strike 18 is slotted at 66 and 68 in medial section 54 to receive laterally extending shanks 70 and 72 of interlock bar 36. These shanks are capped by oppositely extending heads 74 and 76. These heads fall in behind retaining sections 78 and 80 of the strike. The sections interfere with the heads of the interlock bar when the jamb and the door are both experiencing loads tending to pull them apart. This interference prevents escape of lock bolt 16 from the keeper mortise in the strike. The strike is open adjacent the ends of medial section 54 for receipt upon closing door 13 of the interlock bar shanks 70 and 72 in slots 66 and 68 of the strike with heads 74 and 76 behind retaining sections 78 and 80 of the strike. The outwardly facing edges of the ends of the medial section may be beveled to pilot the shanks of the interlock bar.

Figure 2:
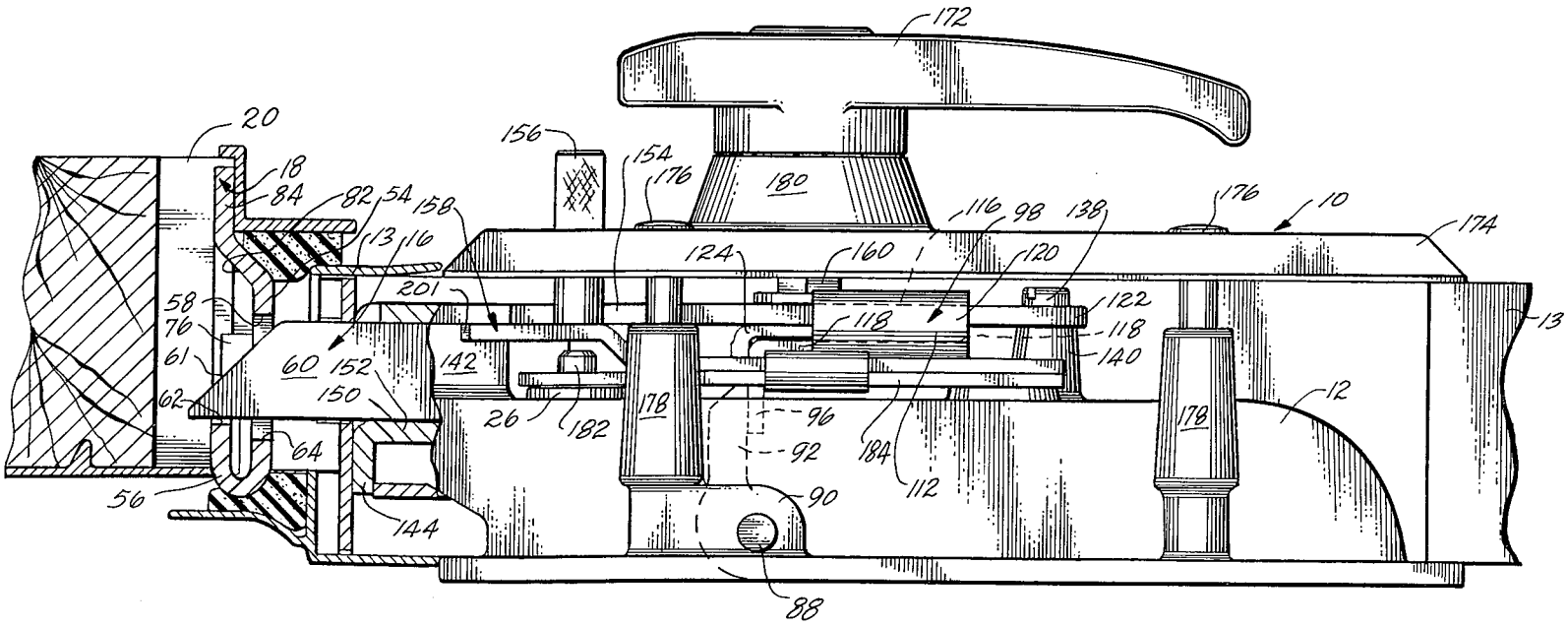
FIG. 2 is a top view, partly in section, of the lockset and strike illustrated in FIG. 1.

As can be seen in FIGS. 1 and 2, the sectional depth of the strike against bending loads in a plane parallel to the major surfaces of the door and wall is improved by a transition section 82, which connects medial section 54 with a longitudinal flange 84. The flange is in the plane of the mounting tabs and merges into them. The surface of the medial section adjacent the mortise may also be "creased" slightly to increase the effective section there and stiffen the strike.

With reference to FIG. 1, bar 36 is wide relative to its thickness to present a substantial surface of heads 74 and 76 to retaining sections 78 and 80 of the strike and resist separation loading between a door and a jamb. The bar has a passage 86 for lock bolt 16.

Figure 4:
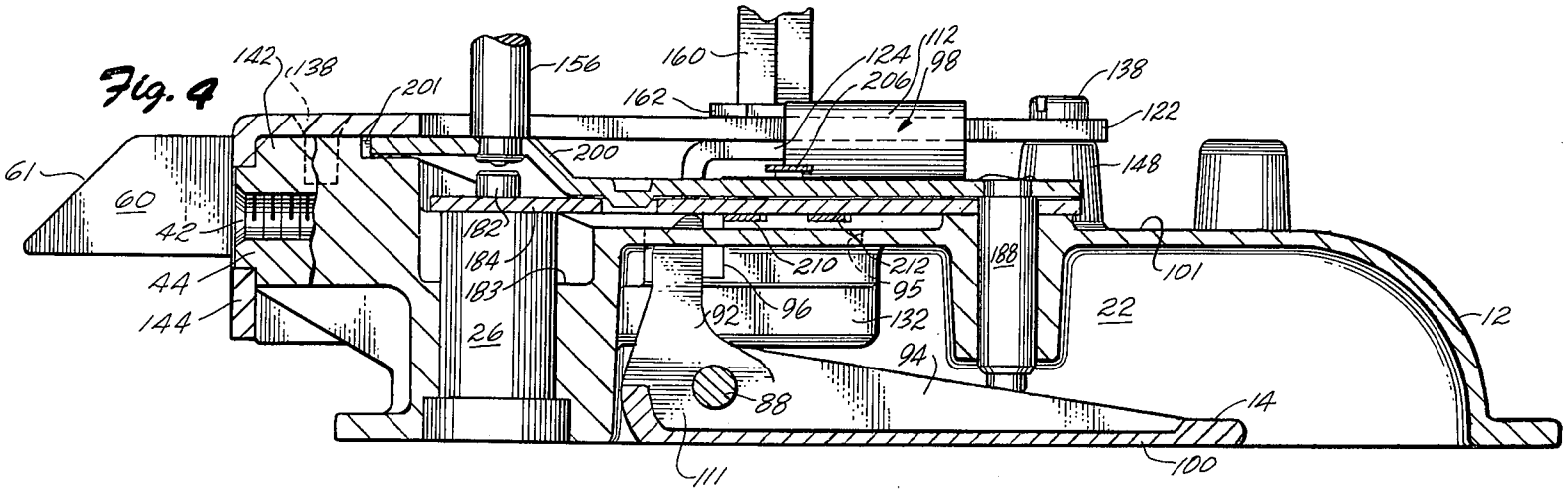
FIG. 4 is a partial sectional view taken generally along lines 4—4 of FIG. 1.
Figure 3:
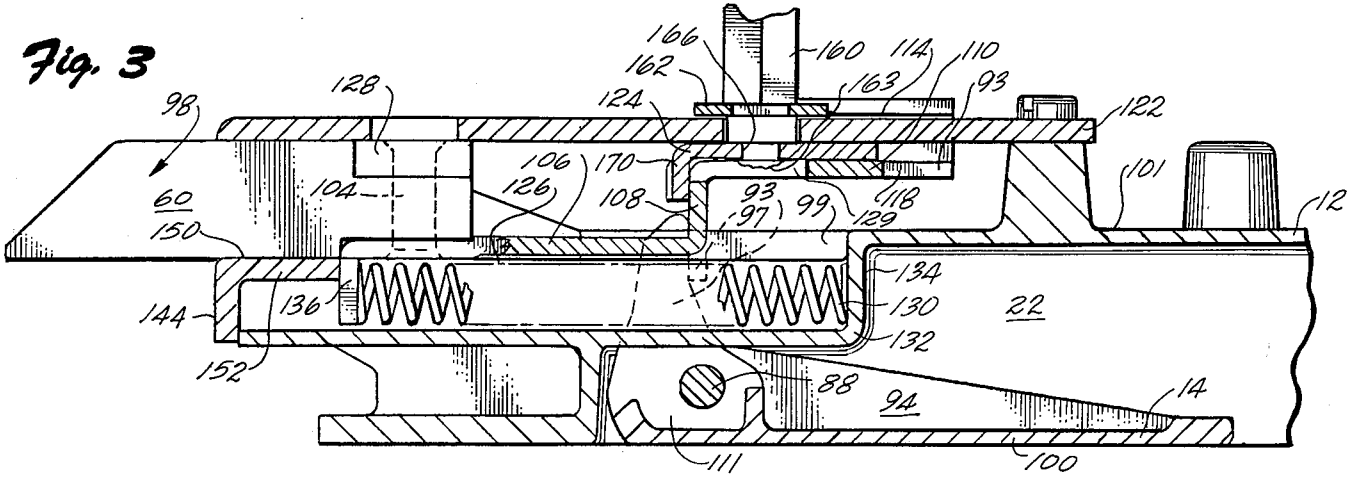
FIG. 3 is a partial, fragmented sectional view taken generally along lines 3—3 of FIG. 1.
Figure 5:
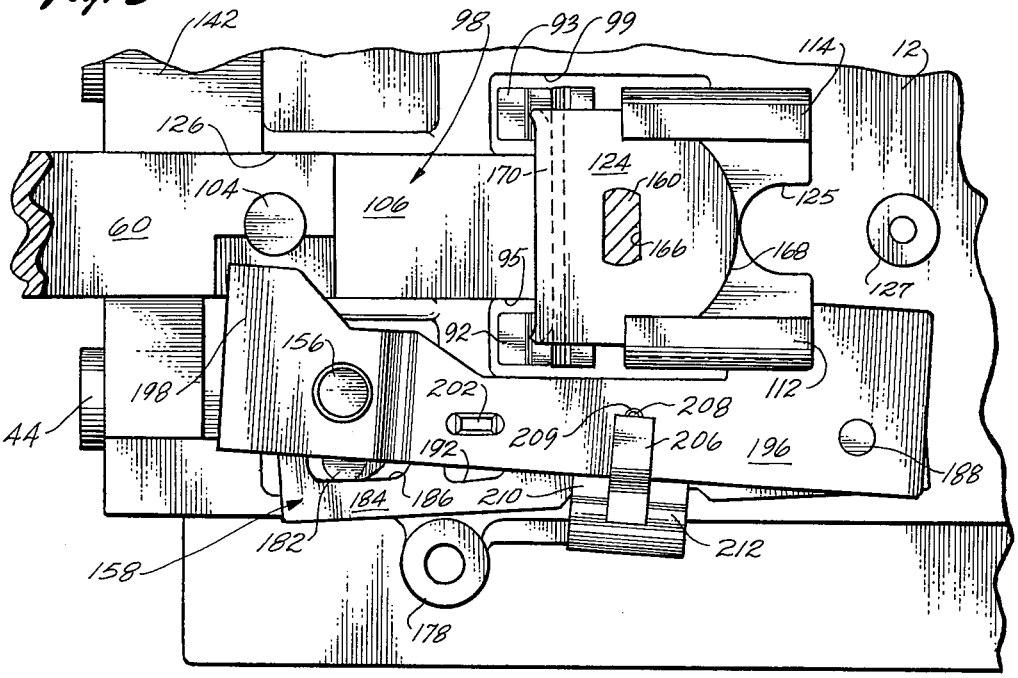
FIG. 5 is an elevational fragmentary view of the lockset of the present invention illustrating a lock cam plate and a lock bolt in cooperation, and a lock lever and a lock bolt locked.
Figure 6:
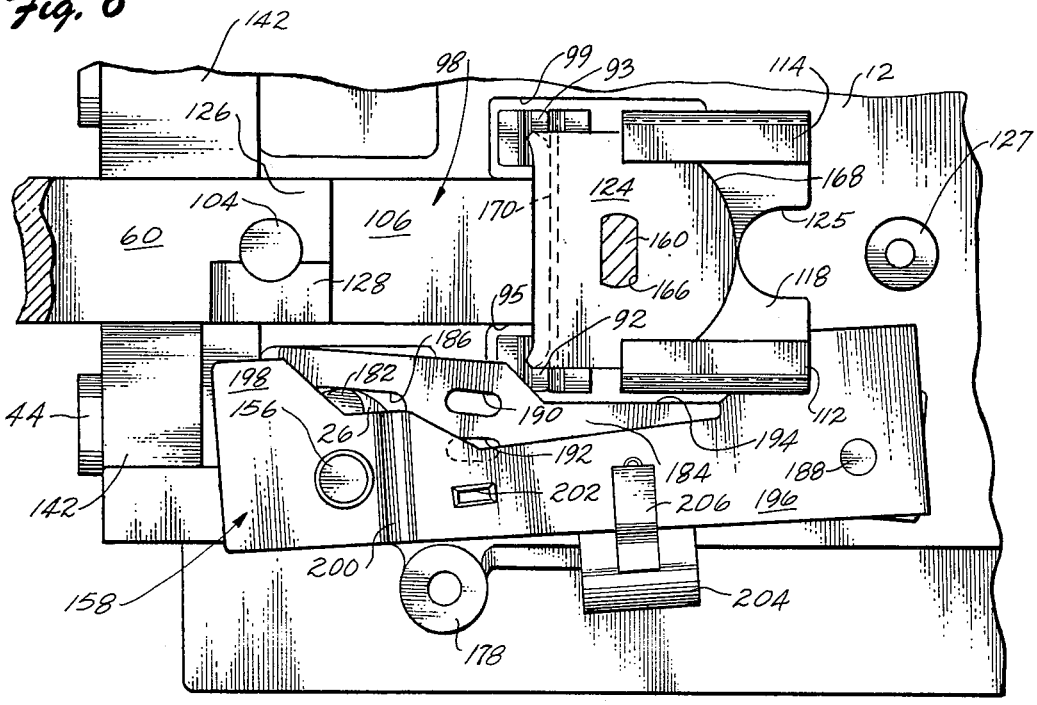
FIG. 6 is a view similar to FIG. 5 illustrating the lock lever in an unlocked position with a follower lever out of coincidence with the lock lever.
Figure 7:
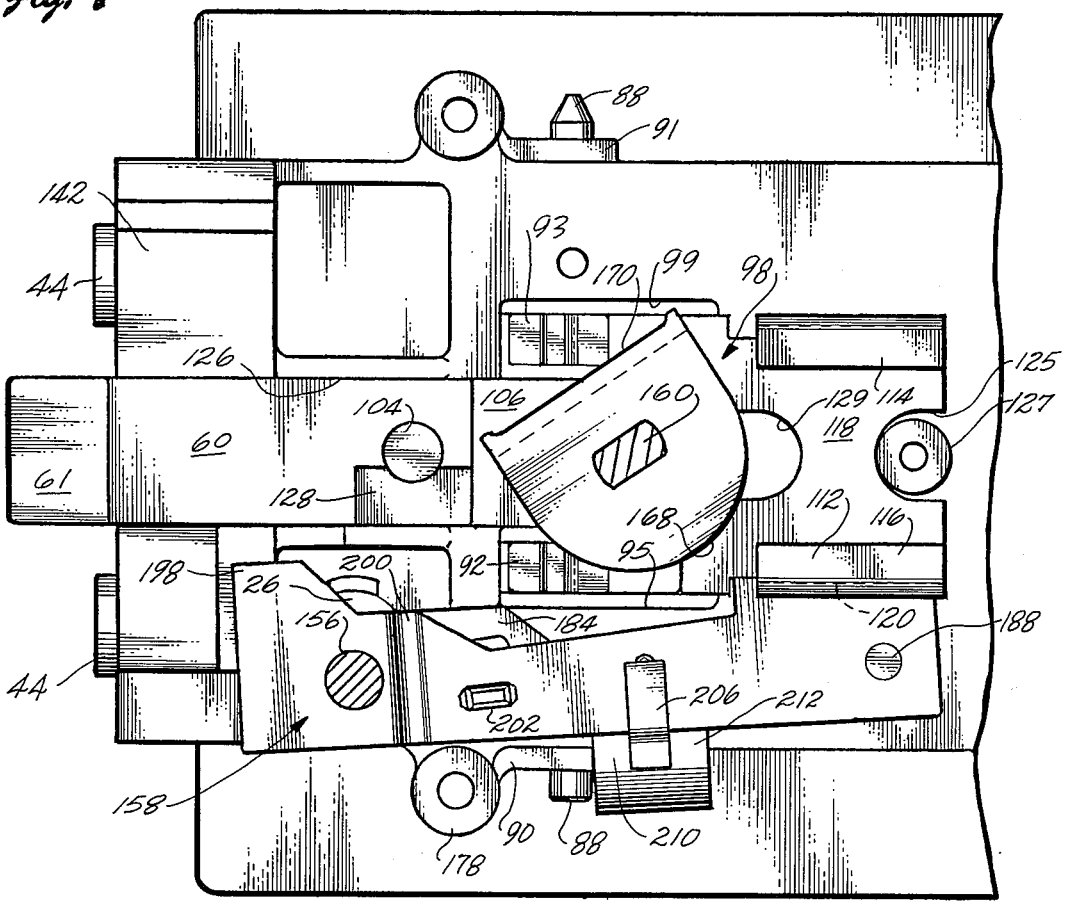
FIG. 7 is a view similar to FIGS. 5 and 6 but illustrating the cam plate in action and the lock unlocked with the levers in coincidence.
Figure 8:
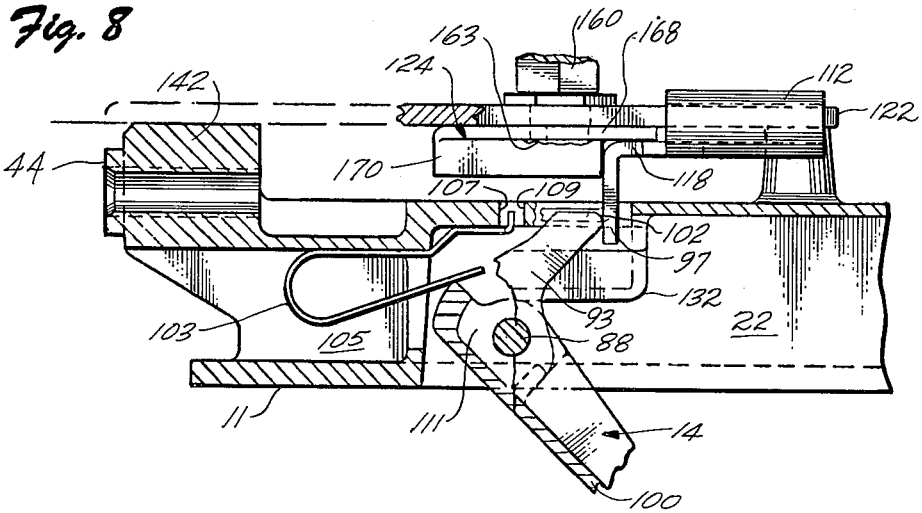
FIG. 8 is a bottom, fragmentary, sectional view, taken generally along lines 8—8 of FIG. 1 illustrating hand lever actuation of the lock bolt assembly.

With reference generally to FIGS. 2, 3 and 4, monolithic body 12 of the lockset is formed as by die casting. Lever 14 is pivotally mounted to the body through pin 88. The pin, in turn, egresses through pin bosses on either side of the lockset, one of which is shown at 90 in FIG. 2 and both are shown at 90 and 91 in FIG. 7. Lever 14 has a pair of spaced-apart lever fingers 92 and 93. As seen in FIGS. 5 through 7, these fingers are spaced along pin 88. Actual mounting of the lever to the pin occurs at the base of the fingers. As again seen in FIGS. 5 through 7, the fingers reside in longitudinal slots 95 and 99 in the body. As is appreciated from FIGS. 3 and 4, the slots extend through the body from pocket 22 and open at an inner surface 101 of the body. Gussets 94 extend along the length of the lever for reinforcement. The lever fingers act on depending tabs 96 and 97 of a monolithic lock bolt assembly 98 (see FIGS. 3, 4 and 8). Lever 14 has a grip 100 which joins at about a right angle lever fingers 92 and 93 through a hub 111. The grip is pulled to operate the lever. The fingers have substantially flat surfaces adjacent surfaces of the tabs of the lock bolt assembly when the assembly and fingers are each in repose. (The repose position is with the lock bolt extended for receipt in the mortise of the strike.) The nose of each of the fingers is radiused for smooth actuation on an associated tab of the lock bolt assembly; see radius 102 of finger 93 in FIG. 8. The lever and its lever fingers are primarily contained in recess 22, which is relatively deep and long and bounded by material of the body. As seen in FIG. 8, a leaf spring 103 urges lever 14 closed and flush with the face of escutcheon 11. The spring bears on an offset from the hub of the lever to exert a counterclockwise force thereon (in the Figure). The spring is in a space 105 in body 12 provided for it. The spring bears on an upper wall bounding the space and is retained by a crooked end in a slot 109 in the body over pivot 88.

Lock bolt assembly 98 is shown in FIGS. 2 through 7 and includes nose 60 secured to the balance of the assembly as through a rivet 104 (FIGS. 3 and 7). As seen best in FIG. 3, the balance of the assembly extends generally horizontally from the rear of the nose and begins as thin flat section 106 under the rear of the nose. The section continues to a vertical step 108. The step forms a structural web for tabs 96 and 97 and joins these tabs to the balance of the lock bolt assembly. A follower and guide section 110 extends horizontally from the top of the step rearwardly with respect to the nose. The follower and guide section generally parallels section 106. Step 108 is generally at right angles to the sections it joins. As is apparent from the Figures, the follower and guide section has a pair of opposed, U-shaped in cross section, guides 112 and 114. Specifically, and with reference to guide 112 and FIGS. 2 and 7, an upper flange 116 extends inwardly over a base 118 of section 110 towards the line of motion of the lock bolt assembly. Flange 116 is spaced from the base by a vertical bite 120. Thus, between the upper flange and the base of the follower and guide a slot is defined. This slot receives and guides on a guide plate 122 which is fixed to the body. The slot also receives a cam plate 124 (see, for example, FIG. 6). Guide 114 is a mirror image equivalent of guide 112. Thus the guides track on guide plate 122 which defines a straight and horizontal path for the reciprocation of the bolt assembly.

As seen in FIG. 7, base 118 of lock bolt assembly 98 is notched at 125 for clearance of guide plate fastener mounting boss 127, the latter being part of body 12. A relatively long slot 129 in base 118 provides clearance for an upset end of a spindle 160 (to be described).

Nose 60, as is seen in FIGS. 3 and 7, is notched at 128 with a ramp-like notch for receipt of the nose or dog of a locking lever, to be described. As is seen in FIGS. 3 and 7, lock bolt assembly 98 through flat section 106 and nose 60, guides in trough 126 of the monolithic body. Primary guidance and bearing of the lock bolt assembly is by guide plate 122, as will subsequently appear.

As seen in FIG. 3, a compression spring 130 is in a housing 132 of body 12. The spring bears on a vertical wall 134 of the recess. The opposite end of the spring bears on a downwardly struck pad 136 depending from section 106 of the lock bolt assembly. The compression spring urges the lock bolt into a closed or extended position with the nose of the bolt received in the mortise of the strike.

As seen in FIGS. 2, 3 and 4, guide plate 122 is simply secured to body 12 as through fasteners 138 received in threaded boss 140 and threads in a head 142 of the body. The guide plate is strong relative to body 12.

A face 144 of the plate bends around head 142 of the body from the major plane of the guide plate. This face faces the jamb. As seen in FIGS. 2 and 3, face 144 is apertured at 150 for the passage of nose 60 of lock bolt assembly 98. Lateral stability of guide plate 122 is aided by interference with bosses 44 (FIG. 4). These bosses also take loading, in shear, occurring when the door in which the lockset is installed is closed and when there are forces which tend to open the door from its closed position. A shoe 152 of the guide plate extends inwardly from face 144 to provide a wear surface between nose 60 and body 12. The shoe is struck from the face and is integral with the face. The bearing provided by shoe 152 complements the bearing provided for the lock bolt assembly by the major plane portion of the guide plate. The edges of the aperture in the face through which nose 60 extends, and extending from the shoe towards the major plane portion, also provide guidance and bearing for nose 60. The guide plate is relatively wide at the face and adjacent the face in comparison to a tail section 154 thereof. The tail section is relatively narrower to provide clearance for a pin 156 of a lock assembly 158 and to provide clearance for the travel of guides 112 and 114 of lock bolt assembly 98. Where the guides track, the guide plate sides are parallel to each other and the path of the guides and receive the guides.

With particular reference to FIG. 3, an acircular in cross section spindle 160 extends through guide plate 122 and is rotatably secured there as through a standard spring clip 162 and an upset end 163 of the spindle bearing on cam plate 124. It is for upset end 163 that clearance slot 129 in base 118 of lock bolt assembly 98 is provided. The slot is also shown in FIG. 7.

Cam plate 124 is secured to the spindle for rotation with it through a periphery complementing hole 166 in receipt of the spindle (see FIGS. 5 and 6 also). The cam plate is sandwiched between upset end 163 and the guide plate. As seen in FIGS. 5 through 7, the cam plate as viewed along the axis of the spindle presents a generally semicircular posterior periphery at 168. This periphery joins two parallel sides which meet at downwardly extending anterior flange 170 (the flange is shown to best effect in FIGS. 3 and 8). The interior outer edges of this flange are disposed to bear on downwardly depending tabs 96 and 97 and the adjoining edge of the balance of base 118 of the lock bolt assembly. Flange 170 retracts the lock bolt from the strike mortise upon rotation of the cam plate in either direction by bearing on and moving the lock bolt assembly. In repose, tabs 96 and 97 and flange 170 are in compressive engagement to provide and define the extended position of the lock bolt assembly. Compression is by spring 130. The semicircular periphery of the cam plate clears the U-shaped guides of the lock bolt assembly. More specifically, the cam plate overlies the lock bolt assembly, and the posterior end of the cam plate is received between the U-shaped guides of the former.

As can be seen from FIG. 2, spindle 160 mounts a handle 172 in a standard manner. An interior escutcheon 174 is mounted on the interior side of the lockset as by a plurality of fasteners 176. These fasteners are threaded into threaded bosses 178 of body 12. A hub 180 of escutcheon 174 spaces handle 172 from the balance of the exterior surface of the escutcheon.

The lockset of the present invention has a unique lock which enables the locking of the lock bolt in the mortise from either the inside or the outside of the lockset and the unlocking of the lock bolt from the side of the lockset opposite that from which locking was effected. The lock is shown best in FIGS. 2, 4, 5, 6 and 7. This characteristic avoids such circumstances as young children inadvertently locking themselves inside a space employing the lockset by unlocking with a key from the outside. This feature is effected with a very simple structure. The lock includes a standard plug lock in the form of a barrel lock 26 which egresses in the face of escutcheon 11. This barrel lock has a key-turned eccentric lug 182. A recess 183 in the body provides a space around the interior end of the barrel lock and a shoulder of the body for a keeper to keep the lock in place. A follower lever 184 is slotted at 186 (see FIGS. 5 and 6). The edge of the slot defines a follower surface for following the eccentric. The follower lever is pivoted through a pivot pin 188 on body 12. A pair of detent slots 190 and 192 in follower 184 are spaced from each other along a circular band defined by inner and outer radii, each originating at the axis of pivot 188. The centers of both slots lie on a circle having a radius with an origin at the center of pivot 188. As viewed in FIG. 6, the edge of the follower facing lock bolt assembly 98 is notched at 194 to provide clearance with the lock bolt assembly. A lock lever 196 is pivoted at one of its ends at 188 on the same pivot pin as follower 184. The locking lever generally overlies the follower. A nose or dog 198 of the locking lever extends laterally inward towards notch 128 of nose 60 of lock bolt assembly 98. In the locked position this dog enters the slot and prevents, through interference with the nose, retraction of the lock bolt assembly by either handle 172 or lever 14. The dog is stepped up at 200 from the balance of the locking lever, which is generally planar, to afford proper clearance for eccentric lug 182. The body has a recess 201 (see FIGS. 2 and 4) to receive dog 198. The body and the guide plate over this recess prevent excessive bending of lock lever 196 by pulling or pushing on pin 156. A detent 202 is struck in the locking lever for engagement in either of detent slots 190 and 192 of follower 184. A spring clip 204 urges the two levers together for detent engagement in either of the detent slots. With particular reference to FIG. 5, spring clip 204 has a medial leg 206. A projection 208 of the leg extends at right angles from the leg and engages lever 196 in a hole 209 of the latter. Outer legs 210 and 212 underlie and press against follower 184 but are not attached to it so that there can be sliding motion between the clip and follower. Again, the interior peripheral edge of the lock bar is notched for clearance of various of the lock bolt assembly components. Detent 202 can be in one or the other of detent slots 190 or 192, or outside the detent slots.

In operation, assuming the lockset is unlocked, and it is desired to open a door on which the lockset is mounted with lever 14, one merely grabs grip 100 (FIG. 4) of the lever and pulls outwardly away from the exposed face of escutcheon 11. FIG. 8 shows the action of lever 14 on the lock bolt assembly and the latter retracted. Rotation of the lever around the axis of pivot 88 rotates actuating fingers 92 and 93 against tabs 96 and 97 to retract the bolt against the counteracting force of return spring 130. The opening of the latch bolt in this manner is done independent of cam plate 124.

When the grip is released, the lock bolt assembly returns to its extended position because of the action of spring 130. (This spring and the assembly responsive to it are shown in FIG. 3.)

When it is desired to retract lock bolt assembly 98 by interior handle 172 (FIG. 2), one merely turns the handle in either direction to bear one end edge or the other of anterior flange 170 of cam plate 124 against step 108 of the lock bolt assembly (FIG. 3). Again the lock bolt will retract against the force of spring 130. Upon removal of the force on handle 172, which keeps the camming surfaces of cam plate 124 against step 108, the lock bolt assembly will extend under the action of spring 130.

Beginning with FIG. 6, the operation of lock assembly 158 will be described. (In this description directional words are with reference to the lock bolt assembly.) Detent 202 is outwardly of the outer edge of follower lever 184 and free of detent slots 190 and 192. Here dog 198 of the lock lever is outside notch 128 of nose 60 of lock bolt assembly 98, and the lock bolt assembly is free to respond to actuation by either lever 14 or handle 172. Barrel lock lug 182 bears on the inside edge of the follower slot 186. When it is desired to lock the lockset from the side of lever 14 with a key, it is necessary to rotate the key so that lug 182 rides on the outside side of slot 186 to force the follower more in line with the lock lever and the outside detent slot 192 into receipt of detent 202. (The lever side of the lockset is normally the "outside" of a door equipped with a lockset.) When the outside detent slot receives the detent, follower 184 picks up lock lever 196. Turning the key in the opposite direction rotates lug 182 back into the position it had at initiation of the process. This time, however, lock lever 196 is carried with follower 184 and lug 182, and dog 198 is moved in notch 128 to effect an interference lock of the lock bolt assembly. The lock lever and follower are also in coincidence in this locked position. Just before this happens and at the pick-up of the lock lever by the follower, various parts have the orientations shown in FIG. 7, except that in this Figure the lock bolt is shown retracted rather than extended. Obviously, the lock bolt must be extended for receipt in notch 128 of nose 198. As seen there, the levers are in coincidence and both are in an outer position from the locked orientation just achieved.

If it is desired to unlock the lock from its lever side, one merely turns the key in the opposite direction, again so that lug 182 of the barrel lock carries follower 184 and detented lock lever 196 away from the lock bolt. (Again refer to FIG. 7.)

If instead of unlocking the lock assembly when the position of the lock lever and follower are in coincidence and locked from the lever side it is desired to unlock from the side of handle 172 of the lockset (typically the "inside" of a door equipped with the lockset), one merely moves lock lever 196 through pin 156 out of notch 128. This brings the mechanism back to the FIG. 6 position.

To lock from the FIG. 6 position from the handle side, one merely moves pin 156 to rotate lock lever 196 on pivot 188 to detent it with follower 184, detent 202 being in slot 192. Dog 198 is dogged in notch 128.

Returning to the FIG. 7 orientation of the lock with the bolt assembly in its extended position, if it is desired to lock with pin 156, one merely moves the pin and rotates the lock lever for insertion of nose 198 in notch 128. Here, however, follower 184 is left in its starting position (see FIG. 5), and lug 182 of barrel lock 26 bears against the outside surface of follower slot 186. Detent 202 of lock lever 196 registers in interior detent 190 to keep the lock lever in its locked position. The lock lever and follower lever are out of coincidence.

To unlock from the side of lever 14 from the FIG. 5 position, one merely rotates barrel lock 26 to bring lug 182 to bear against the inside follower surface of slot 186 and move follower detent slot 192 into engagement with detent 202 in lock lever 196. In this position the lockset is locked from both "inside" and "outside" of a door. With the lock lever thus picked up, opposite rotation of the barrel lock lug brings dog 198 out of notch 128 and the levers back to the FIG. 7 orientation.

To unlock from the FIG. 5 position (levers out of coincidence) with pin 156, one merely forces the pin away from notch 128 to bring the levers to their FIG. 7 position once again.

The preferred embodiment of the present invention has been described from time to time with the aid of directional words appropriate for the Figures, such as lateral, horizontal, inside and outside. It should be appreciated that such words were used for convenience and clarity and were not meant to imply in-use configurations consistent with the directional terminology used. In addition, the spirit and scope of the appended claims should not, necessarily, be limited to the foregoing description.

What is claimed is:

1. An improved lockset for mounting in a door and securing the door in a jamb, the lockset having a jamb end, an interior end opposite the jamb end, an outside for facing the outside of the door, and an inside for facing the inside of the door, the improvement comprising:

a. a monolithic body having a head with a straight line channel proximate the jamb end;

b. a lock bolt assembly in the channel of the body for translation along a path between a retracted and an extended position, the extended position having a portion of the lock bolt externally of the body on the jamb side thereof for receipt in a mortise of the jamb, the retracted position having the lock bolt withdrawn from the extended position for clearance of the mortise, the lock bolt assembly having U-shaped in cross section guides on the interior end of the lockset and facing the path;

c. a guide plte overlying the lock bolt assembly on the inside of the lockset, abutting the head of the body and secured to the body, capturing the lock bolt assembly in the channel, and received by the guides for maintaining the interior end of the lock bolt assembly along the path;

d. means for biasing the lock bolt assembly into its extended position;

e. means on the inside of the lockset for manually retracting the lock bolt assembly;

f. means on the outside of the lockset for manually retracting the lock bolt assembly; and g. means for locking and unlocking the lockset from either side thereof.

2. The improved lockset claimed in claim 1 wherein: the guide plate has bearing means on the jamb end for sliding bearing of the lock bolt assembly around the perimeter thereof which is normal to the path.

3. The improved lockset claimed in claim 2 wherein the means for manually retracting the lockset from the inside includes:

a. a spindle rotatably secured to the guide plate;

b. means on the spindle for rotating the spindle in either direction from the inside of the lockset; and c. a cam plate secured to the spindle for rotation therewith, the cam plate having cam means for engaging and retracting the lock bolt assembly upon rotation of the spindle rotating means in either direction.

4. The improved lockset claimed in claim 3 wherein:

a. the lock bolt assembly includes a step parallel to the axis of rotation of the spindle; and b. the cam plate cam means includes a flange engageable with the step to retract the lock bolt assembly.

5. The improved lockset claimed in claim 4 wherein:

a. the means for retracting the lock bolt assembly from the outside includes a lever pivotally secured to the body about an axis normal to the path; and b. the lever has actuating fingers extending toward the inside of the lockset and engageable with the flange for retracting the lock bolt upon rotation of the lever about its pivotal axis away from the inside of the lockset.

6. The improved lockset claimed in claim 5 wherein:

a. the body has a pair of parallel slots parallel to the path on either side of the lock bolt and between the flange and the pivot axis of the latch; and b. the actuating fingers extend through the slots.

7. The improved lockset claimed in claim 1 wherein the guide plate has a face overlying the head on the jamb end, the face having a passage for the lock bolt assembly, and a shoe extending from the face under the lock bolt assembly towards the interior end, the sides of the passage, the shoe and the overlying portion of the guide plate providing bearing and guiding surfaces for the lock bolt assembly.

8. An improved lockset for mounting in a door and securing the door in a jamb, the lockset having a jamb end, an interior end opposite the jamb end, an outside for facing the outside of the door, and an inside for facing the inside of the door, the improvement comprising:

a. a monolithic body having a head with a straight line channel proximate the jamb end;

b. a lock bolt assembly in the channel of the body for translation along a path between a retracted and an extended position, the extended position having a portion of the lock bolt externally of the body on the jamb side thereof for receipt in a mortise of the jamb, the retracted position having the lock bolt withdrawn from the extended position for clearance of the mortise, the lock bolt assembly having guide means on the interior end of the lockset and facing the path;

c. a guide plate overlying the lock bolt assembly on the inside of the lockset, abutting the head of the body and secured to the body, capturing the lock bolt assembly in the channel, cooperating with the guide means for maintaining the interior end of the lock bolt assembly along the path, and having a face overlying the head on the jamb end, the face having a passage for the lock bolt assembly, and a shoe extending from the face under the lock bolt assembly towards the interior end, the sides of the passage, the shoe and the overlying portion of the guide plate providing bearing and guiding surfaces for the lock bolt assembly;

d. means for biasing the lock bolt assembly into its extended position;

e. means on the inside of the lockset for manually retracting the lock bolt assembly;

f. means on the outside of the lockset for manually retracting the lock bolt assembly; and g. means for locking and unlocking the lockset from either side thereof.

9. An improvement in locksets of the type adapted to be mounted in a door to keep the door tight with a door jamb, the lockset having a jamb end for facing the door jamb, an interior end opposite the jamb end, an inside for proximity to the inside of the door, an outside for proximity to the outside of the door, a lock bolt assembly translationally mounted in the lockset, the lock bolt assembly having a nose for insertion in a mortise of the jamb and the keeping of the door with the jamb, a handle on the inside of the lockset for retraction of the lock bolt assembly from the mortise and the freeing of the nose from the mortise upon rotation of the handle in either direction about an axis normal to the direction of translation of the lock bolt assembly, a lever on the outside of the lockset for retraction of the lock bolt assembly from the mortise and the freeing of the nose from the mortise upon rotation of the lever about a pivot axis normal to the direction of translation of the lock bolt assembly, and means for locking the lock bolt assembly with the nose in the mortise from either the inside or the outside of the lockset and for unlocking the lock bolt assembly from either the inside or the outside, the improvement comprising:

a. a monolithic body of the lockset, the body having a head at the mortise end, a channel in the head receiving the nose and defining the direction of translation of the lock bolt, and a pair of slots between the head and the interior end opening through the body on either side of the lock bolt assembly;

b. the lever having actuating fingers extended through the slots in the body for rotation with the lever;

c. the lock bolt assembly includes a thin plate secured to the nose, the plate being stepped between the slots and having a guide section extending toward the interior end from the step, the guide section having a pair of opposed channel shaped guides, the actuating fingers being engageable with the step to retract the lock bolt assembly from the mortise upon rotation of the lever;

d. a cam plate secured to the handle for rotation therewith and having a flange paralleling the axis of rotation of the handle, the flange being engageable with the step to retract the lock bolt assembly from the mortise upon rotation of the handle;

e. a guide plate overlying the cam plate and lock bolt assembly and being secured to the body, the guide plate overlying the nose for sliding engagement therewith to keep the nose in the channel, the guide plate also receiving the channel shaped guides to guide the interior end of the lock bolt assembly along the direction of translation; and f. means for biasing the lock bolt assembly into an extended position for insertion of the nose in the mortise.

10. The improvement claimed in claim 9 wherein the guide plate has a face extending over the jamb end of the body and passing the nose.

11. The improvement claimed in claim 10 wherein a shoe extends inwardly from the face for sliding engagement by the nose on the opposite side thereof from the guide plate.

12. The improvement claimed in claim 11 wherein the face has a passage which provides the pass for the nose, the shoe bounding a side of the passage, the remaining sides of the passage also providing for sliding engagement by the nose.

13. The improvement claimed in claim 9 wherein the step has depending tabs, the tabs being engageable by the actuating fingers of the lever for the retraction of the lock bolt assembly.

14. The improvement claimed in claim 9 wherein the nose of the lock bolt assembly is solid and one piece.

15. The improvement claimed in claim 9 wherein the body defines an escutcheon on the outside of the lockset.

16. In a lockset of the type having a translatable lock bolt for engaging in an extended position the mortise of a door jamb, means for retracting the lock bolt from the extended position to free the lock bolt from the mortise from the inside of a door equipped with the lockset, means for retracting the lock bolt from the extended position to free the lock bolt from the mortise from the outside of the door, and lock means for locking the lock bolt in the mortise from either side of the door and for unlocking the lock bolt from either side of the door regardless of from which side the door was originally locked, an improvement in the lock means comprising:

a. a lock lever pivotally secured in the lockset for movement between a first position in locking engagement with the lock bolt to prevent retraction thereof from the mortise and a second, unlocked position free from the lock bolt;

b. a follower lever pivotally secured to the lockset for movement between a first position and a second position;

c. a lug operable from outside the door to move the follower lever between its positions;

d. means for engaging the lock lever and the follower lever in the second position of each and upon operation of the lug in a first direction to carry the lock lever with the follower lever to the first position of each to lock the lock bolt and upon operation of the lug in the opposite direction to carry the two levers to their second position and unlock the lock bolt; and e. means to lock and unlock the lock bolt directly from inside the door including a detent in one of the levers and a detent slot in the other lever positioned for engagement with each other when the lock lever is in its first position and the follower lever is in its second position to maintain the lock lever in the first position and the lock bolt locked.

17. The improvement claimed in claim 16 wherein the engaging means includes a second detent slot in the lever of the first detent slot and engageable by the detent in the first position of the lock lever and the first position of the follower lever for moving the lock lever to its second position through operation of the lug and by carriage by the follower lever to the latter's second position.

18. The improvement claimed in claim 17 wherein the detent is free from both detent slots when the lock lever is in its first position and the follower lever is in its second position.

19. The improvement claimed in claim 18 including means for biasing the lock lever and the follower lever together, the biasing means comprising a spring attached to one of the levers and slidably engaging the other lever.

20. The improvement claimed in claim 18 including means for accepting a key and with the key for operating the lug.

21. The improvement claimed in claim 20 wherein the means for locking and unlocking the lock bolt directly from the inside of the door includes a manually actuatable pin secured to the lock lever to pivot it between its positions.

22. The improvement claimed in claim 21 wherein the lock lever has a dog, the lock bolt has a notch, and the lock lever locks the lock bolt by the dog being inserted in the notch in the lock lever first position to interfere with the lock bolt in the direction of retraction thereof.

23. In a lockset of the type having a lock bolt spring biased into an extended position for receipt in a mortise, means for retracting the lock bolt from the mortise from an inside side of the lockset, and means for retracting the lock bolt from the mortise from an outside side of the lockset, an improved lock comprising:

a. a lock lever pivotally mounted to the lockset on one side of the lock bolt, the lock lever having a locked position in interference engagement with the lock bolt in the direction of retraction thereof, and a free position out of interference with the lock bolt to permit the latter to be retracted by either of the retracting means;

b. a follower lever pivotally mounted to the lockset on the same pivot as the lock lever, the follower lever having an enclosed slot;

c. a detent on one of the levers;

d. a pair of spaced apart detent receiving slots in the other lever, each slot and the detent being equally spaced from the pivot, one of the slots being remote from the lock bolt and the other slot being proximate the lock bolt;

e. means to urge the detent into one detent receiving slot at a time;

f. a lug eccentrically mounted to the lockset and disposed in the enclosed slot, the lug being operable from a first side of the lockset to move the follower lever between a first position proximate the lock bolt and a second position remote from the lock bolt, the lug in either position holding the follower lever in that position;

g. means for moving the lock lever between its locked position and its free position independently of the follower lever and from the second side of the lockset opposite the first;

h. the lug being operable to drive the follower lever and engage the detent in the remote detent receiving slot regardless of the position of the levers before engagement and to carry the lock lever between its locked and free positions at the will of the operator of the lug; and i. the detent engaging the proximate detent receiving slot when the lock lever is in its locked position and the follower lever is in its remote position to hold the lock lever in its locked position.

24. For use in a door jamb to receive a lock bolt of a lockset mounted in a door, an improved strike comprising:

a one-piece member having ends adapted to be mounted to the door jamb, a medial section raised from a plane containing surfaces of the ends, a curl in the medial section for transit bearing with a lock bolt upon closing of the door, the curl having a convex outward curvature, a mortise in the medial section having a primary and a secondary lock bolt bearing surface, the secondary surface being a redundant surface to keep a lock bolt upon failure of the primary surface, a pair of spaced apart retaining sections in the medial section, each retaining section having a slot for receipt of a shank of an interlock attached to the lockset, a head of the interlock residing behind the retaining section for interference therewith upon loads in the jamb and the door tending to separate the two.

25. The strike claimed in claim 24 in combination with a one-piece interlock bar, the interlock bar including a bar medial section for mounting on a lockset, a pair of shanks extending outwardly from the ends of the medial section for receipt in the slots of the strike, and a pair of heads capping the shanks and extending away therefrom generally parallel with the bar medial section for receipt behind the retaining sections of the strike.

26. The combination claimed in claim 25 wherein the ends of the curl are beveled and lead into the slots for piloting the shanks of the interlock bar into the slots.

* * * * *